United States Patent [19]

Bolton

[11] Patent Number: 4,805,242

[45] Date of Patent: Feb. 21, 1989

[54] TISSUE PACKET HOLDER

[76] Inventor: Billie J. Bolton, 5065 Titan Ct., Denver, Colo. 80239

[21] Appl. No.: 164,842

[22] Filed: Mar. 7, 1988

[51] Int. Cl.[4] ..... A41D 19/00; A41D 13/10

[52] U.S. Cl. ..... 2/160; 2/161 A; 2/161 R

[58] Field of Search ..... 2/160, 161 R, 161 A, 2/158, 247, 248

[56] References Cited

U.S. PATENT DOCUMENTS

| | | | |
|---|---|---|---|
| 468,149 | 2/1892 | Frank | 2/160 |
| 825,510 | 7/1906 | Bloc et al. | 2/160 |
| 1,154,122 | 9/1915 | Koresy | 2/160 |
| 1,613,664 | 1/1927 | Lewandowski | 2/160 |
| 1,982,431 | 11/1934 | Hines | 2/160 |
| 2,103,711 | 12/1937 | Cole | 2/160 |
| 2,428,477 | 10/1947 | Thompson | 2/247 |
| 2,986,743 | 6/1961 | Eilen | 2/247 |
| 4,326,706 | 4/1982 | Guthrie et al. | 2/160 |

*Primary Examiner*—Werner H. Schroeder
*Assistant Examiner*—Jeanette E. Chapman
*Attorney, Agent, or Firm*—Charles C. Corbin

[57] ABSTRACT

A pocket combination for holding a packet of dispensable paper tissue and for incorporation in a leather ski-glove or other like article of clothing, including a packet-receiving opening in the outer layer of the article, the edges of the opening holding the sides of the packet and an inner layer of material for supporting the bottom, major surface of the packet. There is a first, generally rectangular and flexible packet-retaining flap having a tissue-passing aperture therein and pivotally secured along one of its sides to the article outer layer, adjacent the packet-receiving opening. The periphery of the inner major surface of this first flap is equipped with a Velcro strip and the packet-receiving opening is bordered with a complementary Velcro strip. Thus the first flap is foldable to a closed position in which its Velcro strip engages the complementary Velcro strip, and inner surface portions of the flap engage the top of the packet to hold it against outward movement. The aperture allows tissues to be dispensed from the secured packet. A second, generally rectangular over-flap is also Velcro equipped and has one end secured to the article outer layer, and is foldable entirely over the closed first flap and is releasably held in that position by engagement with a complementary Velcro strip on the article outer layer.

9 Claims, 4 Drawing Sheets

TISSUE PACKET HOLDER

Persons engaged in cold weather activities such as skiing and snow-mobiling often encounter the problem of having to tend to a runny nose. Even when one carries a supply of facial tissues, tending to the runny nose can be an unnecessarily disruptive activity break to the conventionally equipped person when the tissue supply cannot be quickly and conveniently accessed.

One approach to this problem is shown in U.S. Pat. No. 4,244,057 where a disposable absorbent pad, removably attachable to a glove or jacket sleeve, can be used to dab at the runny nose. A major drawback with such devices is that they can become mucus-laden and do not allow the more effective action of blowing the nose. Another solution is presented in U.S. Pat. No. 4,536,889, which shows a nosewiper holding device for skiers which is wrist-mountable. Unfortunately this wiper incorporates rigid molded plastic components which is undesirable since this construction presents a potential hazard to the skier and others, and also does not lend itself to incorporation in a user's apparel such as a glove or sleeve of a jacket.

SUMMARY OF THE INVENTION

In view of the foregoing it is an object of the present invention to provide a construction for holding a prepackaged packet of facial tissues which allows easy access to the tissues when required and which protectively encloses the packet at other times.

Another object of the invention is to provide a construction for holding a tissue packet which lends itself to incorporation in an article of clothing.

A further object is to provide a tissue holder which carries the good safety aspects of a generally flexible, non-rigid construction.

A still further object is to provide a tissue holder which a person can easily open with the gloved hand.

The foregoing and still further objects and advantages are attained by the present invention which provides a construction for incorporation in an article of clothing and for holding a generally rectangular and flat facial tissue packet, which construction includes an opening in the outer layer of the article, and a packet-receiving cavity bounded by the edges of the operating and an inner layer of material. The opening edges hold the packet against lateral movement and the inner layer supports the packet bottom. There is a flexible, generally rectangular first flap which is hingedly affixed at one end to the outer layer, and which flap has a tissue-passing aperture therein. There is a strip of Velcro material along the periphery of the inner side of this first flap which is aligned to engage a complementary strip of Velcro material that borders the packet-receiving cavity, when the first flap is folded to a closed position. When the flap is in this closed position, portions of its inner surface will make engagement with the packet top so as to hold the packet within the cavity, while the flap aperture permits tissue dispensing to take place.

The invention features a second, flexible, generally rectangular protective overflap, also hingedly affixed to the article outer layer, and which is foldable entirely over the closed first flap. This over-flap is equipped with Velcro material in a similar manner to the first flap, and is adapted to engage a complementary Velcro strip on the article outer layer. Additional advantages and novel features of the present invention will be apparent upon a reading to the detailed description and claims which follow.

DETAILED DESCRIPTION

While the foregoing description and the drawings illustrate the incorporation of the novel tissue packet holder construction into a leather glove, it will be apparent that the invention can be advantageously applied to other articles of clothing, such as the sleeve of a jacket or trousers.

Figure 3:
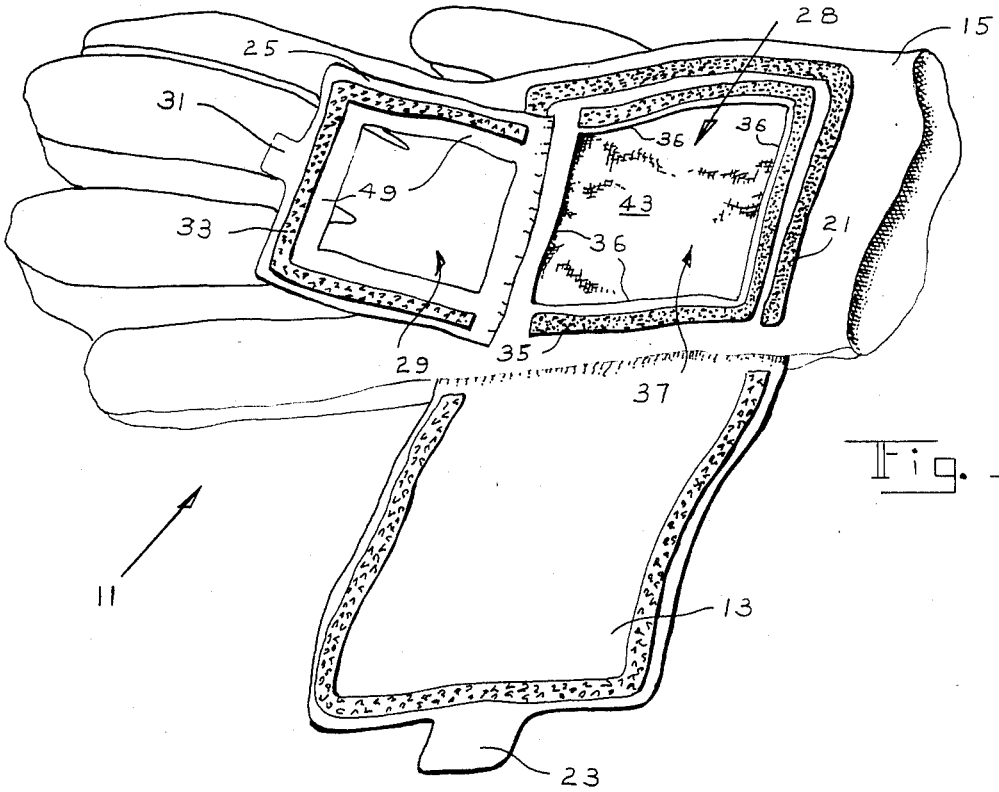
FIG. 3 is a view which illustrates the packet-retaining flap of the invention in its open position.
Figure 5:
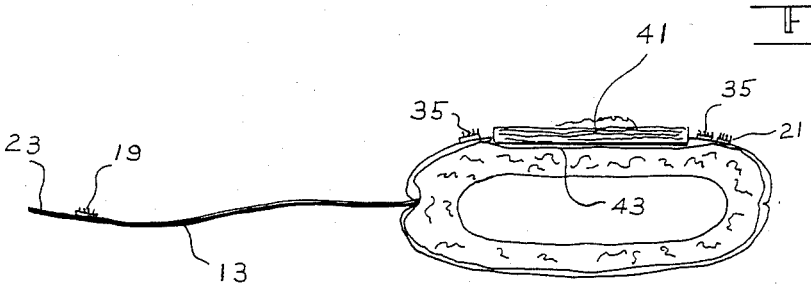
FIG. 5 is a cross-sectional view taken along the line 5—5 of FIG. 4.
Figure 4:
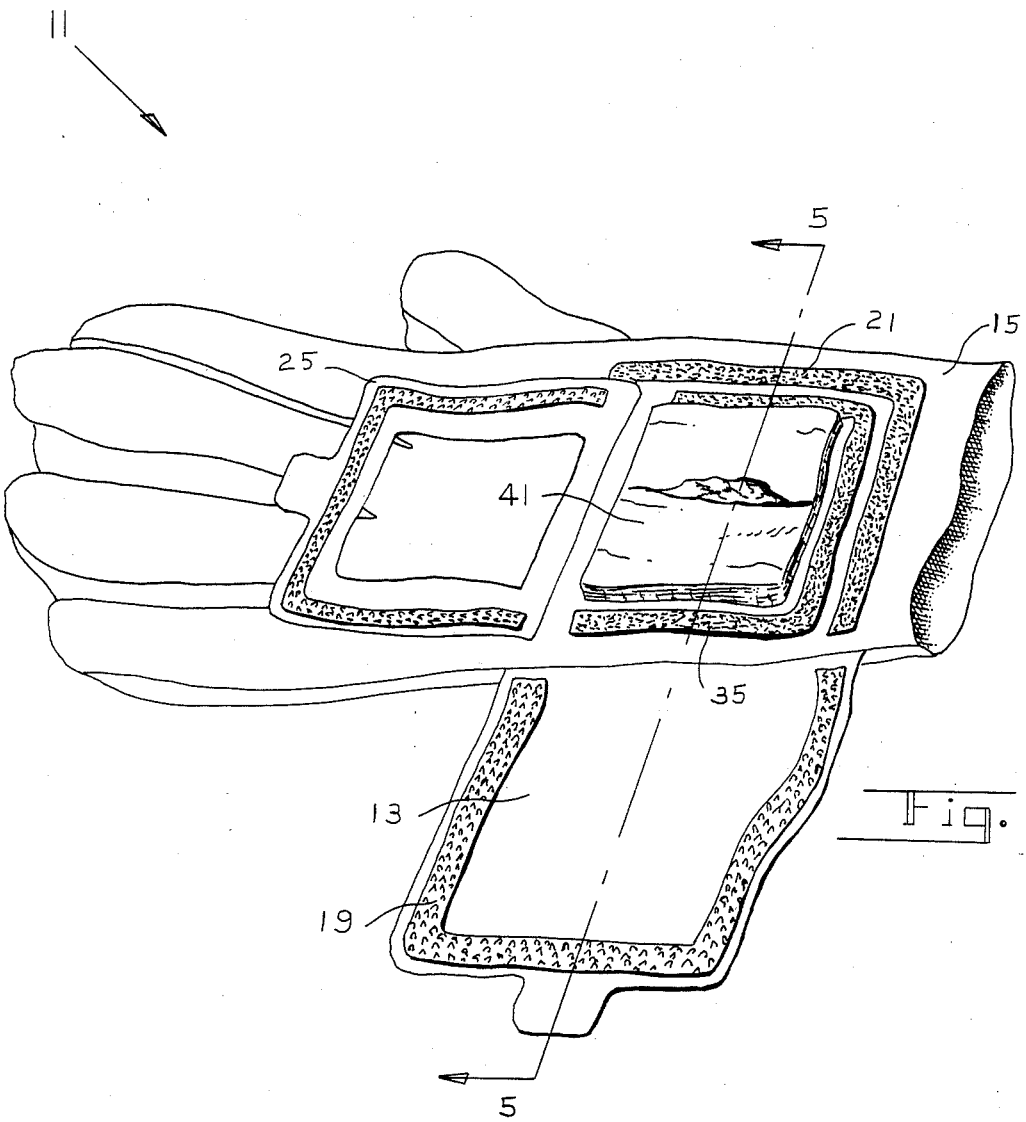
FIG. 4 is a view similar to FIG. 2 but showing a tissue packet in place.

Referring now to the drawings it is shown in FIG. 3 that the major components of the invention, which are incorporated in glove 11, include protective over-flap 13, an inner, packet-securing flap 25 and a packet receiving component indicated by reference numeral 28. The inventive construction is designed to hold a small rectangular packet 41 of disposable tissue, to allow its easy removal and replacement when necessary, to permit dispensing of tissue from the packet and to provide a means to protectively enclose and store the packet from the environment when not being used. The tissue packet 41 is of conventional design and comprises a stack of pre-folded facial tissue sitting upon a rectangular cardboard plate, and encased in a tearable clear paper wrap. The cavity 28 shown in FIG. 3 is formed by the generally rectangular opening 37 in the outer layer 15 of glove 11 which opening is sized to snugly receive packet 41, with the edges of opening 37 engaging the slides of packet 41 to provide lateral stability. The cavity 28 also features an inner support layer 43, shown in FIGS. 3 and 5 and affixed by stitching or the like to the inside of layer 15. This inner layer 43 will support the bottom surface of a packet 41. It is preferred that layer 43 as well as the major components of the inventive structure be composed of the same material as that of the glove outer layer 15; which material is preferably leather. Where material thinner and less dense than leather is used, it may be desirable to reinforce and/or thicken the edges 36 of opening 37, by known methods in the industrial sewing industry, so as to bolster its packet holding capability.

Figure 2:
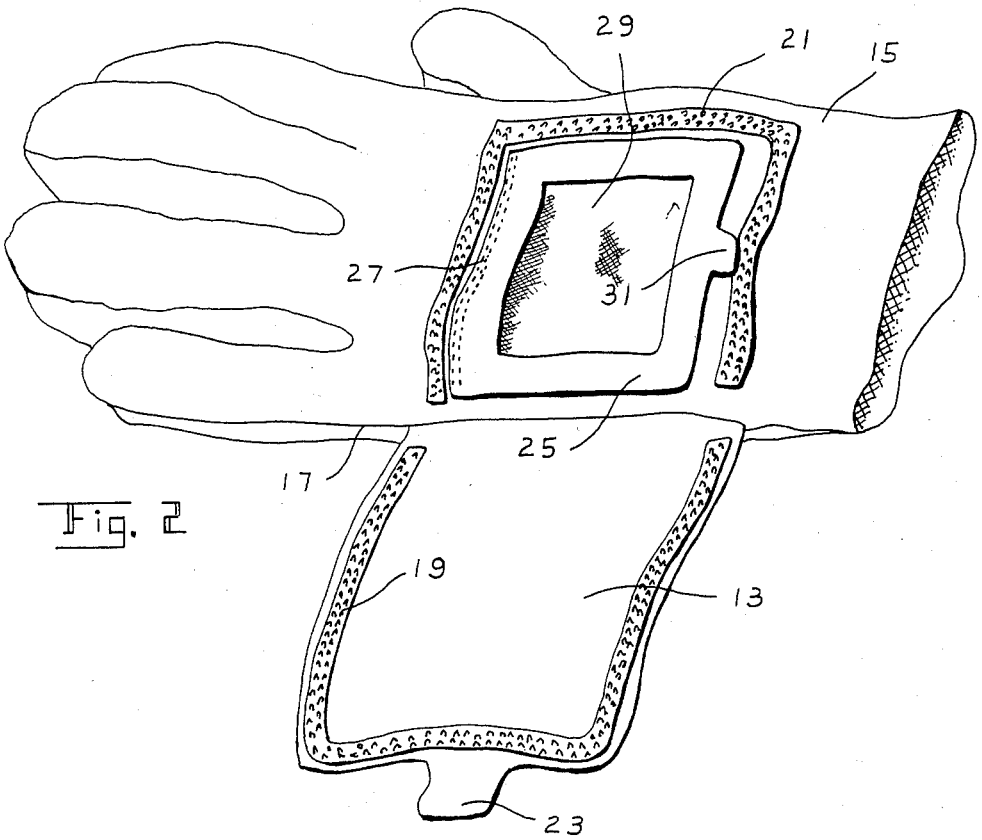
FIG. 2 is a view showing the protective over-flap of the invention in open position.

The first, packet-retaining flap 25, shown in FIGS. 2 and 3 is attached to layer 15 by stitching, or by bonding means to form a hinge-like connection at 27. The flap 25 has a tissue-passing aperture 29, and a strip 33 of hook fastener material such as sold under the trademark VELCRO is secured by stitching along the peripheral portion of the inner side of the flap. A complementary strip 35 of VELCRO loop material is affixed to layer 15 approximate to the border of opening 37. The complementary VELCRO strips 33 and 35 are brought into releasable engagement with one another when flap 25 is folded to the closed position shown in FIG. 2. Note that flap 25 has retaining flange portions 49. These portions will engage top parts of the packet 41 when flap 25 is closed as shown in FIG. 2, so as to retain the packet 41 within the confines of compartment 28. Aperture 29 will allow one to grasp and remove tissues when the invention is in the configuration shown in FIG. 2. To facilitate easy opening and closing of flap 25 the tab 31 is provided, which tab is preferably large enough for grasping by a gloved hand. In the preferred embodiment it is noted that flap 25 has its hinge portion 27 located near the fingered side of glove 11, however flap 25 may be oriented with hinge portion 27 located on any of the sides of cavity 28.

Figure 1:
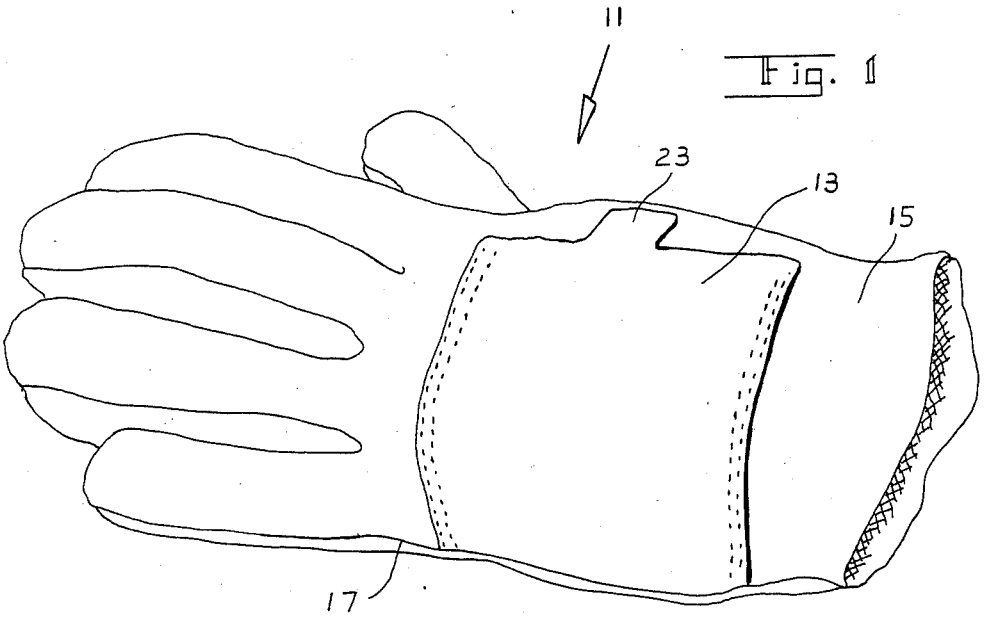
FIG. 1 is a perspective view of a glove which incorporates the tissue packet holder construction of the invention.

An over-flap 13 which is hingedly affixed to outer layer 15, has major dimensions somewhat larger than that of the first flap 25, and has a strip of VELCRO hook material attached to its inner peripheral position as shown in FIG. 2. A tab 23 is designed for easy grasping of over-flap 13. A strip 21 of VELCRO hook material bordering the closed first flap 25, as shown in FIGS. 2 and 3, is affixed to outer layer 15 and is adapted to engage the strap 19 when the flap 13 is folded to its closed position illustrated in FIG. 1.

Figure 7:
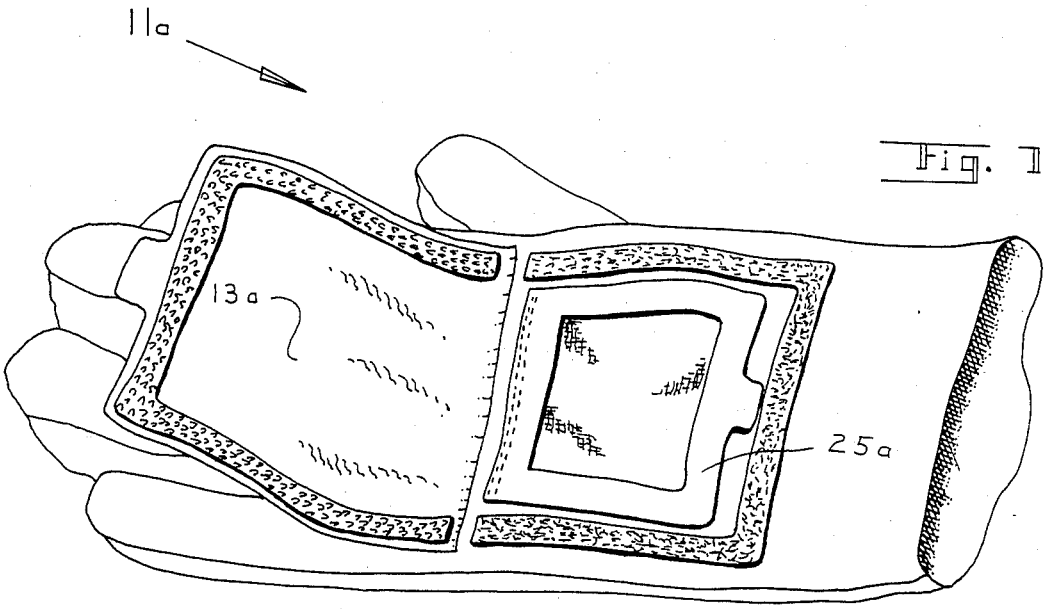
FIG. 7 is a view illustrating a varient of the invention.
Figure 8:
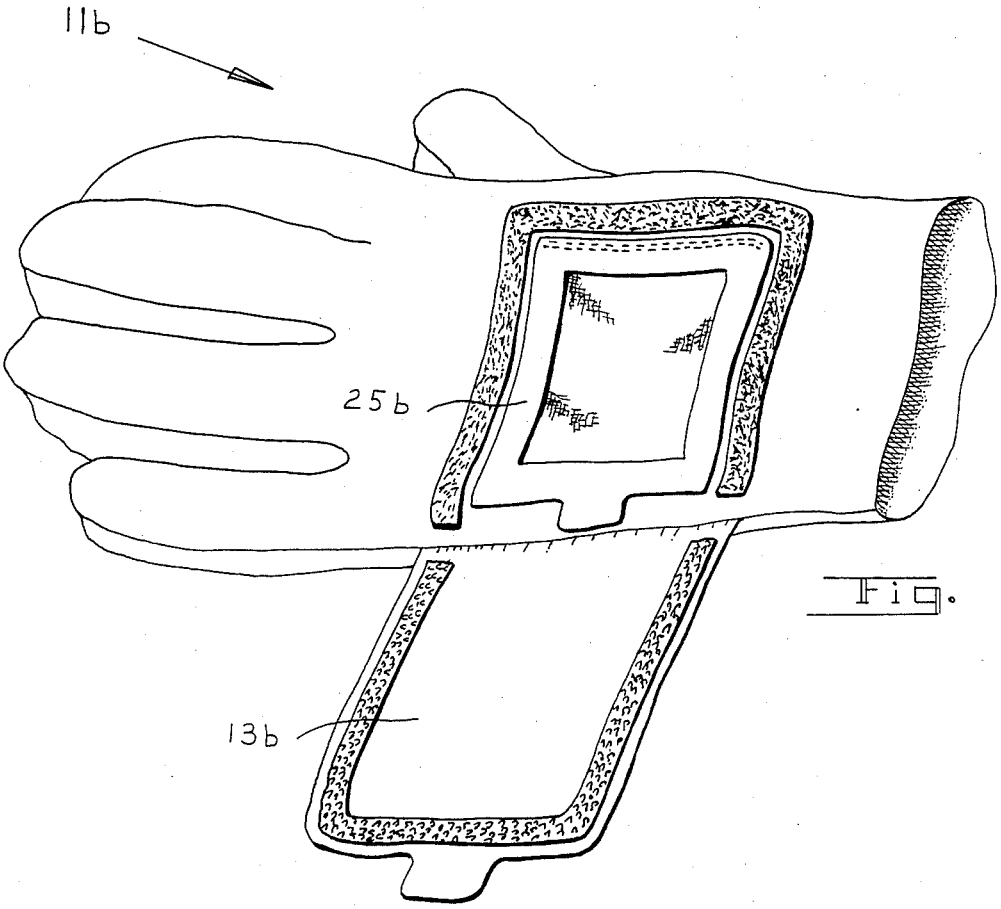
FIG. 8 is a view illustrating another varient of the invention.

FIGS. 7 and 8 show varients of the invention which are similar in construction to the aforedescribed preferred embodiment except for variations in the folding directions of the two flaps. FIG. 7 shows glove **11*a* which has an over-flap 13*a* that is foldable in the same direction as a first flap 25*a*. The varient shown in FIG. 8 shows glove 11*b* with a first flap 25*b* that folds in a direction opposite to that of an over-flap 13*b***.

Figure 6:
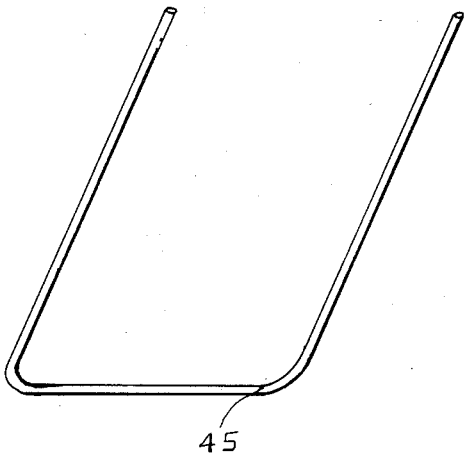
FIG. 6 is a view of a flap stiffening member.

In a modification of the invention a resilient plastic stay 45, such as illustrated in FIG. 6, is incorporated into the flap 25 and flap 13. By using techniques known in the industrial sewing industry, a stay, such as stay 45 is aligned between VELCRO strips 33 and 19, and flaps 25 and 13 respectively, and affixed therebetween.

While this has been described herein particular embodiments of the invention, it will be obvious to those skilled in the art that various changes and modification may be made therein without departing from the invention, and therefore it is aimed to cover all such changes as fall within the true spirit and scope of the invention.

What is claimed is:

1. In combination with an article of clothing, a construction for holding a generally flat and rectangular packet of dispensible tissue paper, including:

(a) packet-receiving means in the outer layer of said garment comprising a cavity bounded by the edges of an opening in said outer layer and an inner layer of material, the edges of said opening adapted to engage the sides of said packet and hold it against lateral movement and said inner layer adapted to support the bottom of said packet against inward movement;

(b) a first, flexible, generally rectangular, packet retaining flap, having one end affixed to said outer layer so as to pivotally mount said first flap adjacent said cavity, and the periphery of the inner surface of said first flap having a strip of Velcro material affixed thereto, and a first complementary strip of Velcro material affixed to said outer layer and bordering said cavity, whereby said first flap is foldable to a closed position in which said first flap Velcro strip releasably engages said first complementary Velcro strip, and said first flap having a tissue-passing aperture therein and an inner surface bordering said aperture which will engage the outer surface of said packet when said first flap is closed so as to retain said packet against outward movement;

(c) generally rectangular, flexible over-flap, pivotally affixed at one of its ends to said outer layer and having a strip of Velcro material affixed along the periphery of its inner surface, and a second complementary strip of Velcro material affixed to said outer layer, whereby said over-flap is foldable to a closed position in which said over-flap Velcro strip releasably engages said second complementary Velcro strip to as to completely cover said first flap.

2. The combination of claim 1 wherein said article of clothing is a hand covering article.

3. The combination of claim 1 wherein said first flap is foldable in a direction at about 90 degrees to the direction in which said over-flap is foldable.

4. The combination of claim 1 wherein said first flap is foldable in the same direction as the direction in which said over-flap is foldable.

5. The combination of claim 1 wherein said first flap is foldable in a direction opposite to the direction in which said over-flap is foldable.

6. The combination of claim 2 wherein said article is a ski glove of leather-like material and said first flap and overflap are also of said materia.

7. The combination of claim 1 wherein said inner layer is attached to said outer layer.

8. The combination of claim 1 wherein the edge portions of said opening in said outer layer are reinforced so as to be substantially thicker than said outer layer.

9. The combination of claim 1 wherein peripheral portions of said first flap and said over-flap have resilient stiffening means attached thereto.

* * * * *